US010151156B2

(12) United States Patent
Gordon et al.

(10) Patent No.: US 10,151,156 B2
(45) Date of Patent: Dec. 11, 2018

(54) SYSTEM AND METHOD FOR AUTOMATED PIPE HANDLING

(71) Applicant: Gordon Bros. Supply, Inc., Stroud, OK (US)

(72) Inventors: Robert Gordon, Stroud, OK (US); Bobby Fisk, Stroud, OK (US); Ronald Gillespie, Stroud, OK (US); Charles Harjo, Stroud, OK (US); David Williams, Stroud, OK (US)

(73) Assignee: Gordon Bros. Supply, Inc., Stroud, OK (US)

( * ) Notice: Subject to any disclaimer, the term of this patent is extended or adjusted under 35 U.S.C. 154(b) by 0 days.

(21) Appl. No.: 15/388,746

(22) Filed: Dec. 22, 2016

(65) Prior Publication Data

US 2018/0179834 A1 Jun. 28, 2018

(51) Int. Cl.
*B66F 11/00* (2006.01)
*E21B 19/15* (2006.01)

(52) U.S. Cl.
CPC ..... *E21B 19/15* (2013.01)

(58) Field of Classification Search
CPC ..... E21B 7/024; E21B 15/04; E21B 7/027; B60P 1/34; B60P 3/122; B60P 3/07; B60P 1/025; B60P 3/125; B66F 7/0625; B66F 7/08
USPC ..... 248/370, 420, 673, 677, 921; 298/11; 254/124, 9 R; 414/22.51–22.59, 414/22.61–22.63
See application file for complete search history.

(56) References Cited

U.S. PATENT DOCUMENTS 1,071,052 A * 8/1913 Hunt ..... B60P 1/34 298/11
2,577,926 A * 12/1951 Stiles ..... B65G 23/44 198/313
2,856,062 A * 10/1958 Kling ..... B65G 65/28 198/302
4,116,413 A * 9/1978 Andersen ..... A47B 23/043 248/451
4,348,054 A * 9/1982 Shonkwiler ..... B62D 53/062 298/11
4,386,883 A * 6/1983 Hogan ..... E21B 19/155 414/22.61
4,512,687 A * 4/1985 Enns ..... B65G 41/002 198/318

(Continued)

FOREIGN PATENT DOCUMENTS

CA 2224638 A1 * 6/1999 ..... E21B 19/14
CA 2510137 A1 * 12/2005 ..... E21B 19/14

OTHER PUBLICATIONS

PCT International Search Report and Written Opinion regarding PCT App. No. PCT/US2017/067377, dated Mar. 8, 2018.

*Primary Examiner* — Gregory W Adams
(74) *Attorney, Agent, or Firm* — Dunlap Codding, P.C.

(57) ABSTRACT

A pipe handling apparatus and method for using the pipe handling apparatus is described. The pipe handling apparatus can be used by putting a boom of the pipe handling apparatus in a nesting position. The boom of the pipe handling apparatus is pivotally mounted to a base and at least one arm. In the nesting position, a pivot point between the at least one arms and the boom is moved within an elongated slot of the boom and the length of the at least one arm is simultaneously adjusted.

12 Claims, 8 Drawing Sheets

(56) References Cited

U.S. PATENT DOCUMENTS

| | | | | | |
|---|---|---|---|---|---|
| 4,739,868 | A * | 4/1988 | Head | B65G 41/002 | 198/316.1 |
| 4,753,408 | A * | 6/1988 | Wailes | H04R 1/026 | 108/145 |
| 5,294,228 | A * | 3/1994 | Willis | E21B 19/155 | 414/22.55 |
| 6,877,942 | B2 * | 4/2005 | Eastcott | B60P 3/00 | 414/22.54 |
| 7,163,367 | B2 * | 1/2007 | Handley | E21B 19/155 | 405/166 |
| 7,473,065 | B2 * | 1/2009 | Wells | E21B 19/155 | 414/22.57 |
| 7,665,944 | B2 * | 2/2010 | Guidroz | E21B 19/14 | 187/211 |
| 2011/0226466 | A1 * | 9/2011 | Funes | E21B 15/00 | 166/85.1 |
| 2013/0251491 | A1 * | 9/2013 | Ludwig | E21B 19/14 | 414/745.8 |
| 2013/0336748 | A1 * | 12/2013 | Hilton | E21B 19/14 | 414/22.62 |
| 2014/0140791 | A1 * | 5/2014 | Yorga | E21B 19/14 | 414/22.59 |
| 2014/0238745 | A1 * | 8/2014 | Dahmes | E21B 19/14 | 175/52 |

* cited by examiner

SYSTEM AND METHOD FOR AUTOMATED PIPE HANDLING

CROSS-REFERENCE TO RELATED APPLICATION(S)

None.

BACKGROUND

Within the oil and gas industry, formation of a string begins on the floor where joints of pipe are assembled. The floor is a relatively small work area where pipe is added to or removed from the string. Some consider the floor to be one of the more dangerous locations on a rig as large heavy metal pipes are in close contact with rig crews and pipes are being lifted every 30-40 seconds at a substantially fast rate.

Generally, the work floor of a drilling/workover rig may be elevated above a pipe rack. Transfer of pipes from the pipe rack to the work floor is a delicate process requiring careful handling. Pipes are generally stacked on the pipe rack. To transfer a pipe from the pipe rack to the work floor, the pipes are generally rolled onto a boom arm that is raised up to the work floor. For example, exemplary systems for transferring a pipe from pipe racks to work floors are described in U.S. Pat. Nos. 7,163,367 and 7,021,880 which are hereby incorporated by reference in their entirety. Such systems raise an end of the boom to the work floor; however, each system includes pre-determined heights or a single set height at which to raise the boom. For example, the height of the boom may be set at pre-determined spacings from a horizontal plane to the work floor. Not all work floors, however, are at the same height. Even further, in such systems, height is not automatically adjustable during use as spacings are pre-determined.

BRIEF DESCRIPTION OF THE DRAWINGS

These and other objects and features of the present invention will be more fully disclosed or rendered obvious by the following detailed description of the invention, which is to be considered together with the accompanying drawings wherein like numbers refer to like parts, and further wherein.

DETAILED DESCRIPTION OF EXEMPLARY EMBODIMENTS

Figure 1:
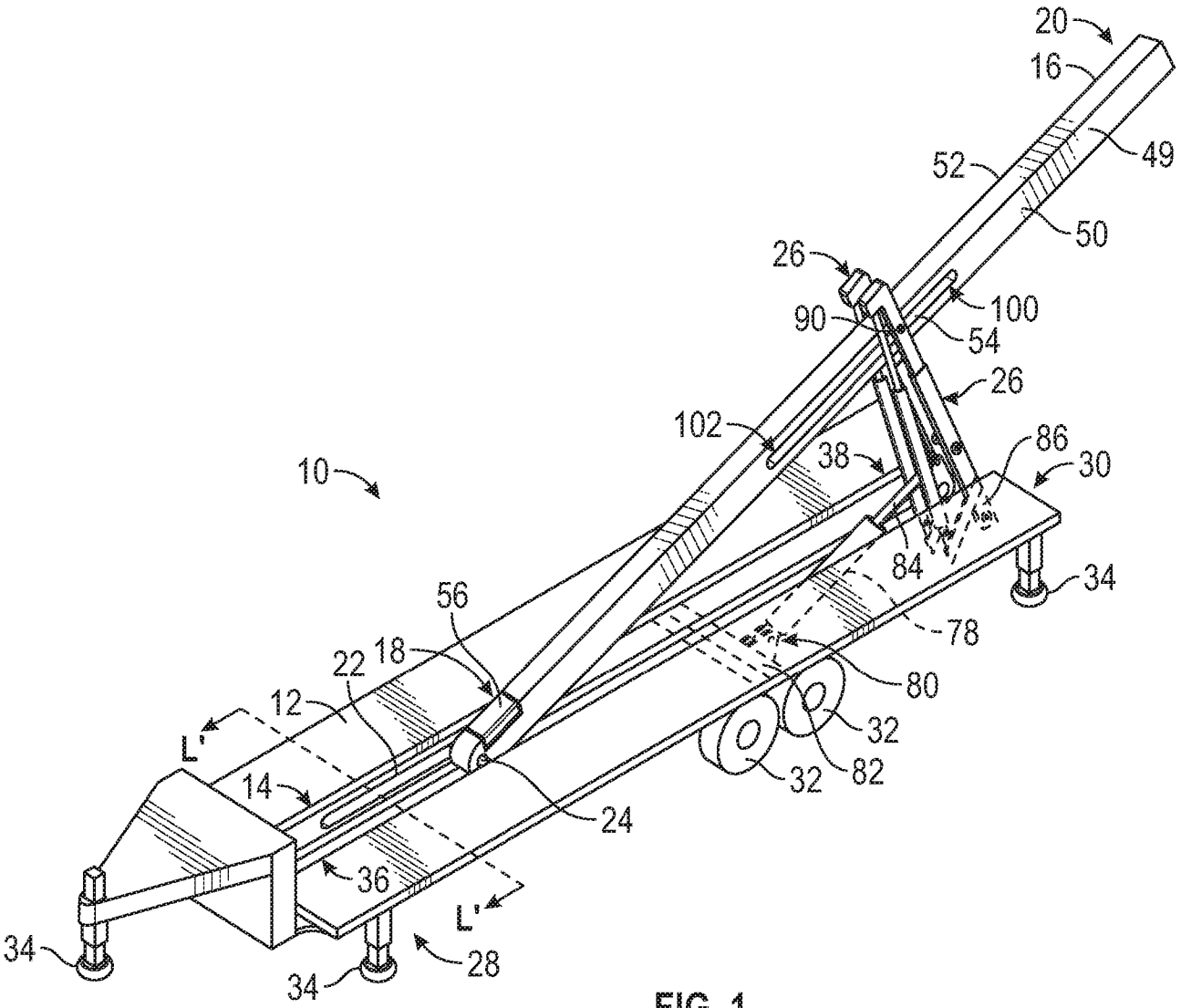
FIG. 1 is a perspective view of an exemplary embodiment of a pipe handling apparatus in accordance with the present disclosure.

Before explaining at least one embodiment of the presently disclosed and claimed inventive concepts in detail, it is to be understood that the presently disclosed and claimed inventive concepts are not limited in their application to the details of construction, experiments, exemplary data, and/or the arrangement of the components set forth in the following description or illustrated in the drawings. The presently disclosed and claimed inventive concepts are capable of other embodiments or of being practiced or carried out in various ways. Also, it is to be understood that the phraseology and terminology employed herein is for purpose of description and should not be regarded as limiting.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, certain well-known features may not be described in detail in order to avoid unnecessarily complicating the instant disclosure.

As used herein, the terms "comprises," "comprising," "includes," "including," "has," "having," or any other variation thereof, are intended to cover a non-exclusive inclusion. For example, a process, method, article, or apparatus that comprises a list of elements is not necessarily limited to only those elements but may include other elements not expressly listed or inherently present therein.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

The term "and combinations thereof" as used herein refers to all permutations or combinations of the listed items preceding the term. For example, "A, B, C, and combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AAB, BBC, AAABCCCC, CBBAAA, CABABB, and so forth. A person of ordinary skill in the art will understand that typically there is no limit on the number of items or terms in any combination, unless otherwise apparent from the context.

In addition, use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

The use of the terms "at least one" and "one or more" will be understood to include one as well as any quantity more than one, including but not limited to each of, 2, 3, 4, 5, 10, 15, 20, 30, 40, 50, 100, and all integers and fractions, if applicable, therebetween. The terms "at least one" and "one or more" may extend up to 100 or 1000 or more, depending on the term to which it is attached; in addition, the quantities of 100/1000 are not to be considered limiting, as higher limits may also produce satisfactory results.

Further, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein qualifiers such as "about," "approximately," and "substantially" are intended to signify that the item being qualified is not limited to the exact value specified, but includes some slight variations or deviations therefrom, caused by measuring error, manufacturing tolerances, stress exerted on various parts, wear and tear, and combinations thereof, for example.

Certain exemplary embodiments of the invention will now be described with reference to the drawings. In general, such embodiments relate to pipe handling systems and methods.

Figure 2A:
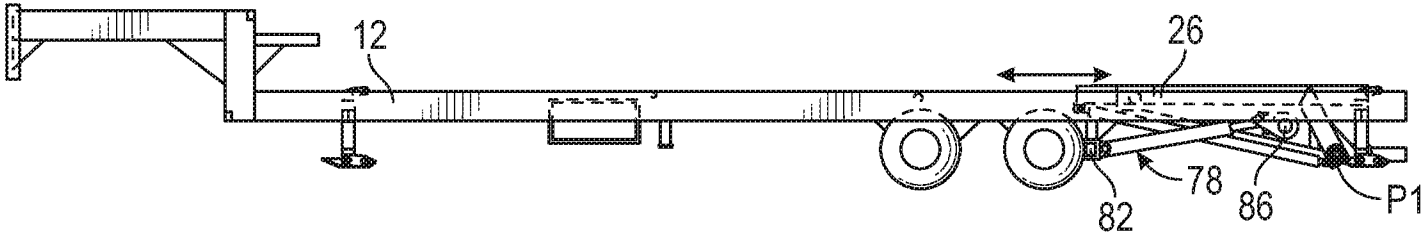
FIGS. 2A and 3A are side elevational view of the pipe handling apparatus in a fully retracted position in accordance with the present disclosure.
Figure 2B:
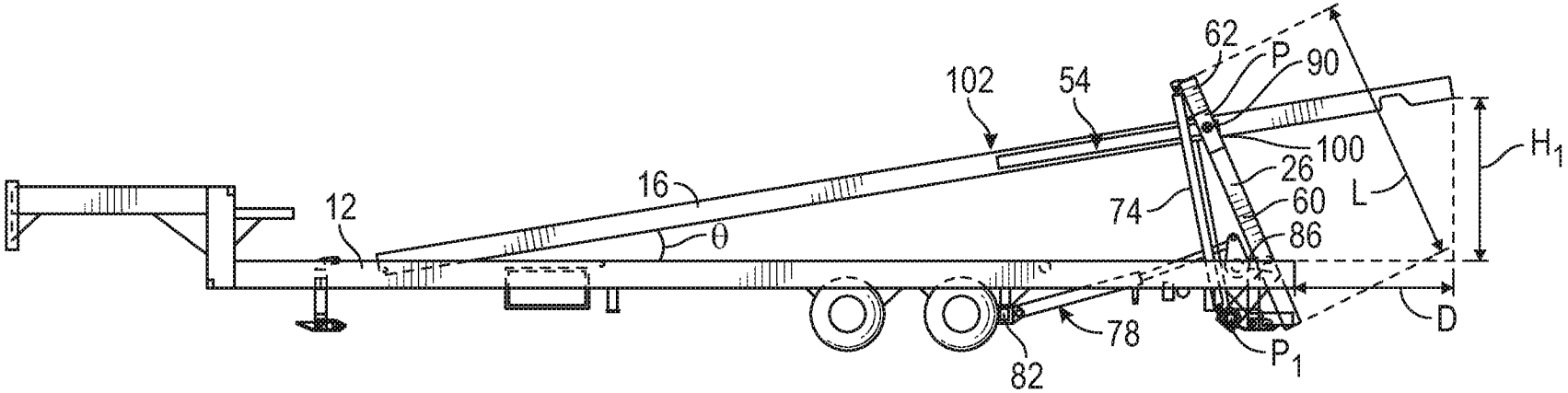
FIGS. 2B and 3B are side elevational views of the pipe handling apparatus in a fully extended position in accordance with the present disclosure.

Referring to FIGS. 1, 2A and 2B, shown therein is a pipe handling apparatus 10 for transporting pipe between a floor (e.g., derrick floor) and a pipe rack. Generally, the pipe handling apparatus 10 includes a base 12 having an elongated channel 14. A boom 16, having a proximal end 18 and a distal end 20, is nestably positioned within the elongated channel 14 when fully retracted. The boom 16 is adapted to receive at least a section of a pipe. FIG. 2A illustrates the boom 16 within the elongated channel 14 in a fully retracted position (i.e., a nesting position) in which the boom 16 is substantially parallel with and bordered by the base 12. The elongated channel 14 of the base 12 includes a track 22 configured to guide the proximal end 18 of the boom 16. In one example, the proximal end 18 of the boom 16 may include at least one roller 24 with the roller 24 engaged with the track 22 such that the track 22 is configured to guide the proximal end 18 of the boom 16 from the nesting position (as shown in FIG. 2A) to a raised position (as shown in FIG. 2B).

The pipe handling apparatus 10 includes at least one and preferably a plurality of arms 26. A particular embodiment of the pipe handling apparatus 10 including two arms 26 is described below. The arms 26 are operably moveable such that the distal end 20 of the boom 16 may be positioned in a plurality of raised positions and the nesting position. For example, FIGS. 2B and 3B illustrate exemplary raised positions wherein the distal end 20 of the boom 16 is positioned at a first height $H_1$ and a second height $H_2$ from the base 12. Raised positions may be such that the distal end 20 of the boom 16 may be positioned at any height H greater than the nesting position illustrated in FIGS. 2A and 3A. Further, adjustment of the distal end 20 of the boom 16 in the nesting position, resulting in a change in the first height $H_1$ to the second height $H_2$ in the raised position, and/or from the first height $H_1$ to the nesting position may be automated (i.e., without human intervention).

Referring to FIGS. 2B and 3B, in general, operation of the pipe handling apparatus 10 includes repositioning of a pivot point P between the boom 16 and the plurality of arms 26 using synchronized extension and retraction of the plurality of arms 26 so as to vary the height H of the distal end 20 of the boom 16. With the proximal end 18 of the boom 16 remaining on the base 12 as the height H increases or the height H decreases, the distance D the distal end 20 of the boom 16 extends from the base 12 may also be increased or decreased as shown in FIGS. 2B and 3B depending on 1) a length of the arms 26, and 2) the location of the pivot point P between the boom 16 and the plurality of arms 26.

Referring to FIG. 1, the base 12 has a proximal end 28 and a distal end 30. The elongated channel 14 may extend between the proximal end 28 and the distal end 30. In some embodiments, the elongated channel 14 extends from the proximal end 28 to the distal end 30 of the base 12. In some embodiments, the elongated channel 14 may extend through only a portion of the base 12 such that additional control and/or power supply may be housed within a portion of the base 12.

The base 12 may be mobile or stationary. For example, in some embodiments, the base 12 may be mounted on an undercarriage assembly. The undercarriage assembly may include wheels 32 and/or two or more legs 34 for stabilization when in operation. In some embodiments, the base 12 may further include a catwalk providing user access to features of the pipe handling apparatus 10.

Figure 4:
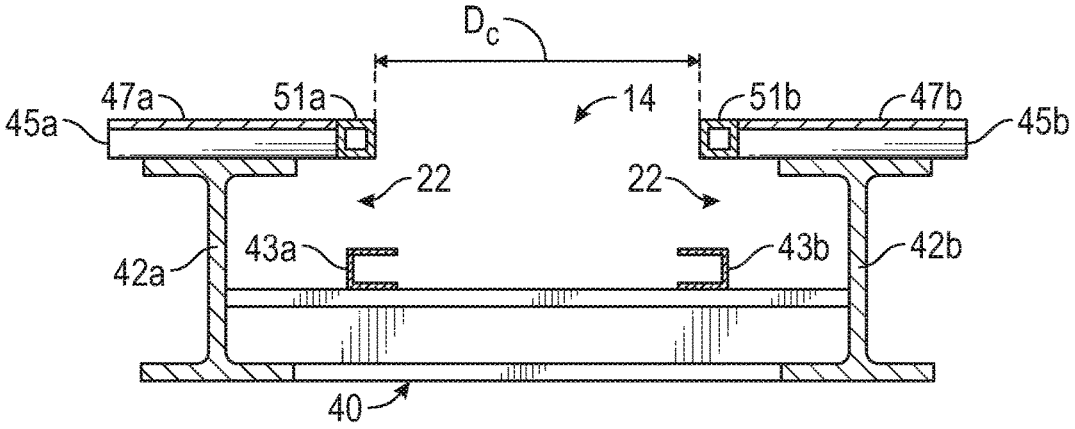
FIG. 4 is a cross-sectional view of an exemplary channel of the boom of the pipe handling apparatus illustrated in FIG. 1.

Referring to FIGS. 1 and 4, the elongated channel 14 includes a proximal end 36 and a distal end 38 with the track 22 extending along at least a portion of the elongated channel 14. The track 22 may be configured to serve as a guide for movement of the boom 16 during operation. For example, as illustrated in FIG. 4, in some embodiments, the track 22 may be a groove formed by a plurality of transverse supports 40 extending between a first longitudinal support 42*a* and a second longitudinal support 42*b*. Each transverse support 40 may extend between the first longitudinal support 42*a* and the second longitudinal support 42*b* such that multiple transverse supports 40 may be spatially disposed but positioned adjacent to each other from at least the proximal end 36 to the distal end 38 of the elongated channel 14. In one example, the transverse supports 40 may be I-beams (e.g., 6-inch I-beams) with at least four transverse supports 40 extending between the first longitudinal support 42*a* and the second longitudinal support 42*b* and positioned adjacent each other from at least the proximal end 36 to the distal end 38 of the track 22.

The longitudinal supports 42*a* and 42*b* may extend at least from the proximal end 36 to the distal end 38 of the track 22. In one example, the longitudinal supports 42*a* and 42*b* may be I-beams (e.g., 14 inch I-beams) extending at least from the proximal end 36 to the distal end 38 of the track 22.

In some embodiments, a plurality of C-channels 43*a* and 43*b* may be positioned on the transverse supports 40 and extend longitudinally at least from the proximal end 36 to the distal end 38 of the track 22. The C-channels 43*a* and 43*b* may be used to contain a plurality of rollers 24 (not shown) mounted on the boom 16 so as to guide the rollers 24 and thus the boom 16 as the boom 16 is moved in the track 22.

In some embodiments, a plurality of transverse structural tubing 45 may be positioned on the longitudinal support 42*a* and the longitudinal support 42*b*. For example, FIG. 4 illustrates transverse structural tubing 45*a* and 45*b* positioned on longitudinal support 42*a* and 42*b* respectively. The transverse structural tubing 45 may be, for example, 2-inch metal tubing (e.g., steel tubing). A plurality of transverse structural tubing 45 may be spatially disposed at least between the proximal end 36 and the distal end 38 of the track 22. For example, each transverse structural tubing 45 may be positioned adjacent to another transverse structural tubing 45 such that six adjacent transverse structural tubing 45 on the longitudinal support 42*a* collectively extend at least from the proximal end 36 to the distal end 38 of the track 22.

In some embodiments, one or more layers 47 may be positioned on the transverse structural tubing 45. Generally, the layer 47 may be sheet metal and positioned longitudinally extending from at least from the proximal end 36 to the distal end 38 of the track 22. For example, in FIG. 4, the layer 47*a* (e.g., layer of sheet metal) positioned on the transverse structural tubing 45*a* may extend longitudinally at least from the proximal end 36 to the distal end 38 of the track 22. In some embodiments, the transverse structural tubing 44 and the layer 47 may form a walkable surface.

In some embodiments, a plurality of longitudinal structural tubing 51 may be positioned adjacent to the transverse structural tubing 45 and border the track 22. Each longitudinal structural tubing 51 may extend longitudinally from the proximal end 36 to the distal end 38 of the track 22. For example, the longitudinal structural tubing 51*a* may be positioned adjacent to the transverse structural tubing 45*a* with the longitudinal structural tubing 51*a* extending at least from the proximal end 36 to the distal end 38 of the track 22. In some embodiments, the longitudinal structural tubing 51 may be, for example, 2-inch metal tubing (e.g., steel tubing).

The rollers 24 at the proximal end 18 of the boom 16 may be positioned within the track 22. The rollers 24 may be moveable within the track 22 such that the proximal end 18 of the boom 16 may be laterally guided along the first longitudinal support 42*a* and the second longitudinal support 42*b*. Even further, the rollers 24 may be rotatable within the track 22 such that the proximal end 18 of the boom 16 may be guided laterally and pivot in an upward or downward direction relative to the base 12. For example, the rollers 24 may be rotatable within the track 22 such that the proximal end 18 of the boom 16 may be rotated and thus angled upwardly at a degree $\Theta$ greater than 0 relative to the base 12 as exemplarily illustrated in FIGS. 2B and 3B.

Figure 3A:
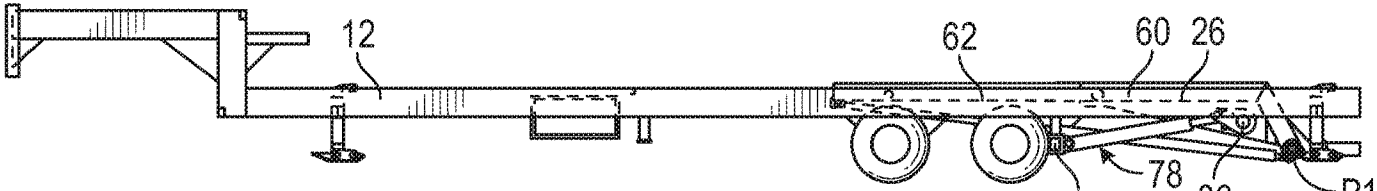
Figure 3B:
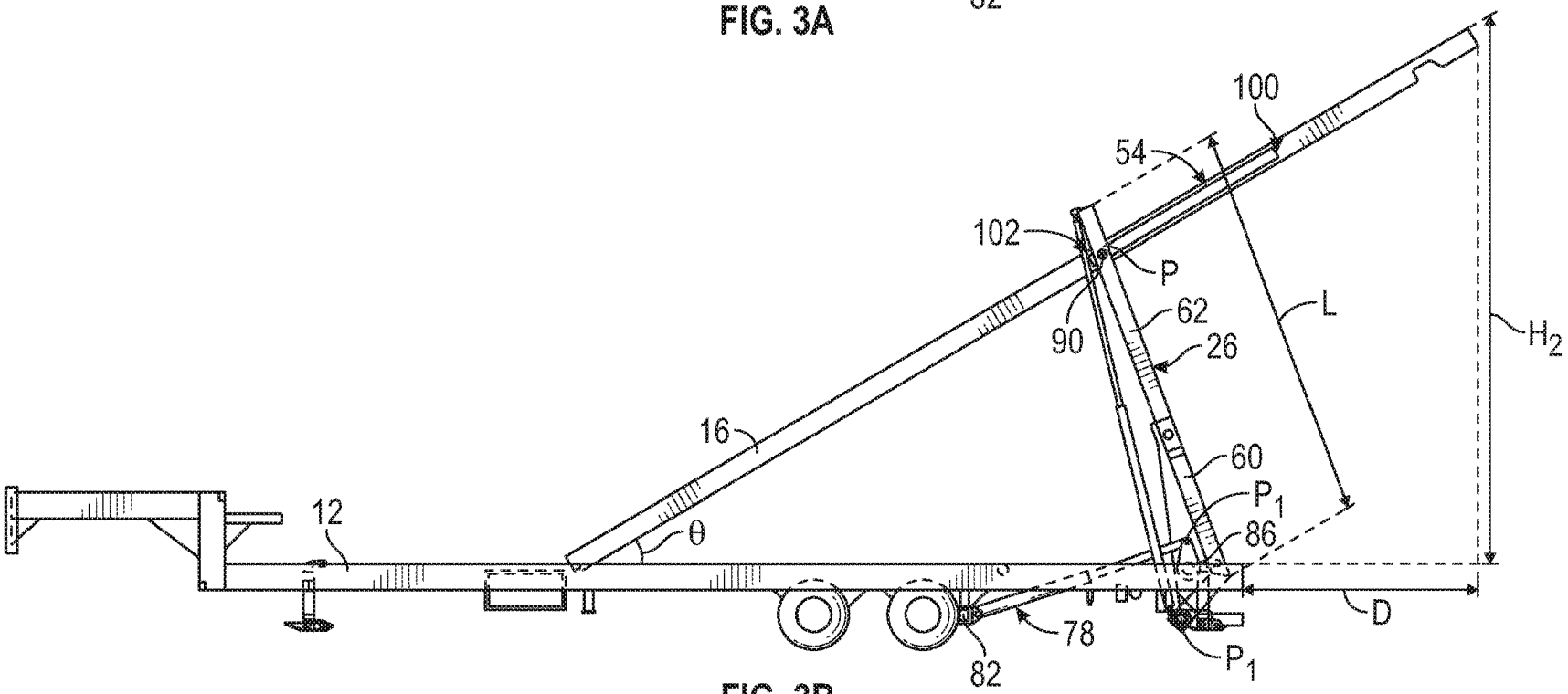

Referring to FIGS. 2A, 3A and 4, the first longitudinal support 42*a* and the second longitudinal support 42*b*, and in particular, the first longitudinal tubing 51*a* and the second longitudinal tubing 51*b* may be configured at a distance $D_C$ apart such that the boom 16 may be positioned within the base 12 in the nested position. The boom 16 may be configured to be nestably positioned within the elongated channel 14 with the proximal end 18 positioned within the elongated channel 14 and distal end 20 of the boom 16 being adapted to be raised out of and lowered into the elongated channel 14.

Figure 5:
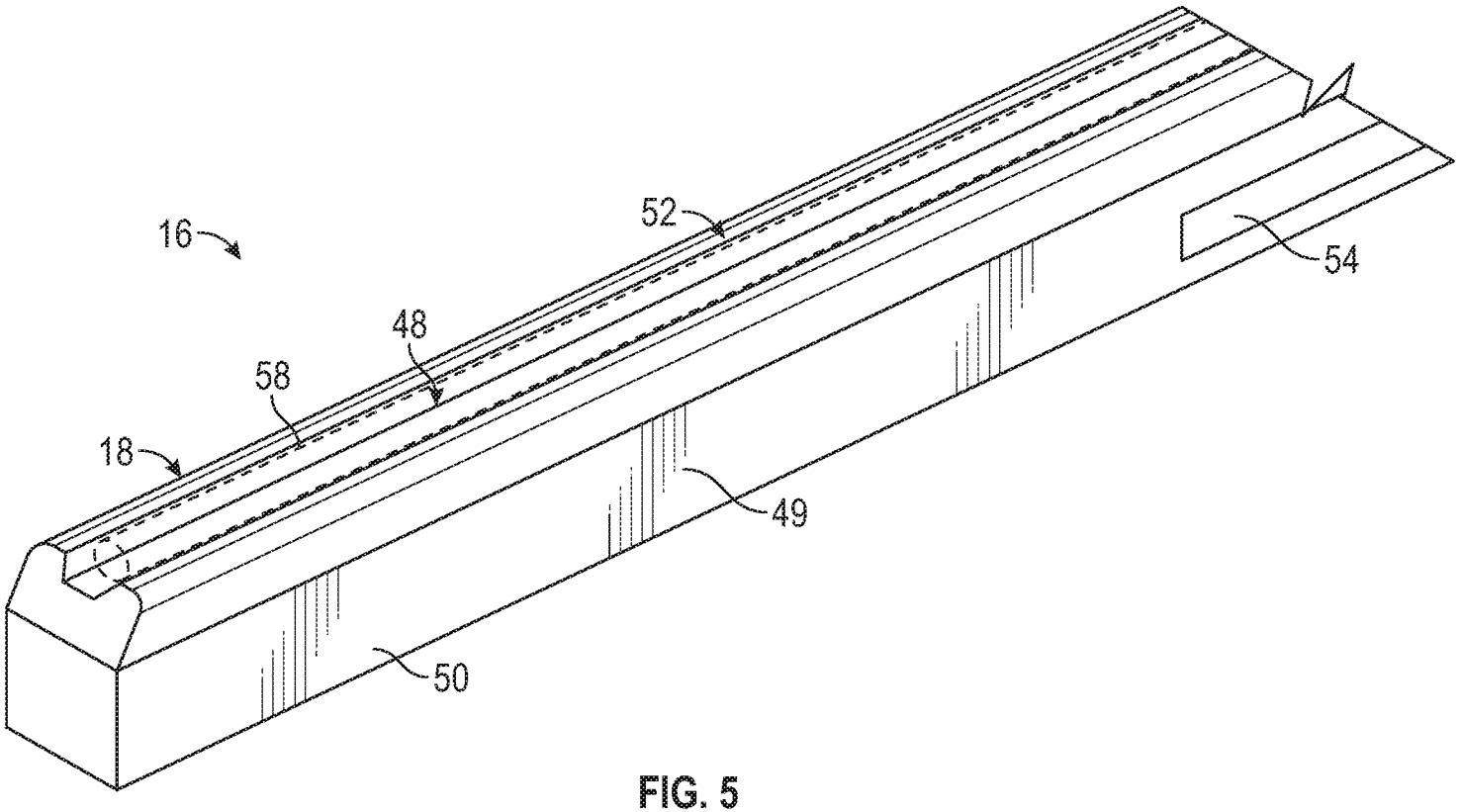
FIG. 5 is a partial perspective view of the boom illustrated in FIG. 1.

FIG. 5 illustrates an exemplary embodiment of the proximal end 18 of the boom 16 illustrated in FIG. 1. The boom 16 may include trough 48 configured to receive a pipe. The trough 48 may extend longitudinal from the proximal end 18 to the distal end 20 of the boom 16. For example, FIG. 5 illustrates a U-shaped indentation forming the trough 48 and extending from the proximal end 18 to the distal end 20 of the boom 16. Other trough shapes are contemplated such as circular, rectangular, V-shaped or any other fanciful shape. For example, the trough 48 may include a circular cross-section for receiving a pipe. The trough 48 may be formed in the boom 16 or fastened thereon. Additionally, in some embodiments, a coating, layer, and/or matting may be applied to the trough 48 and/or any other portion of the boom 16 to absorb kinetic energy and prevent sparks from occurring during placement or movement of the pipe into the trough 48. For example, an elastomeric layer may be applied to the trough 48 to absorb kinetic energy and prevent sparking during placement and/or removal of a pipe.

Referring to FIGS. 1 and 5, the boom 16 may include a beam 49 having a first side 50 and a second side 52. The boom 16 also includes an elongated slot 54 that is formed by a mechanical structure supported by the beam 49. In some embodiments, the mechanical structure includes the beam 49. For example, the elongated slot 54 may extend along a portion of the beam 49 and provide an opening from the first side 50 of the beam 49 to the second side 52 of the beam 49. In some embodiments, the mechanical structure forming the elongated slot 54 may be positioned above the beam 49, or below the beam 49. The mechanical structure can be connected to the beam 49. For example, a first metal plate (not shown) may be connected to the first side 50, and a second metal plate (not shown) may be connected to the second side 52. The first metal plate and the second metal plate may extend below the beam 49 and have the elongated slot 54. In these embodiments, the elongated slot 54 may have a major axis extending substantially parallel to a length of the beam 49. In some embodiments, the boom 16 may include a pipe movement assembly including a pipe engaging member 56 that can be selectively moved by a conveyor (not shown) for engaging and moving a pipe 58 (shown in phantom positioned in the trough 48 in FIG. 5) along the boom 16 for either lowering the pipe 58 or raising the pipe 58 and ejecting the pipe 58. For example, in FIG. 1, the engaging member 56 is a plate positioned at the proximal end 18 of the boom 16. The engaging member 56 may be configured to apply force to the pipe 58 by actuating the conveyor and/or remaining stationary to hold the pipe 58. It should be apparent to a person skilled in the art that different types of engaging members 56 and conveyors may be used and configured to move the pipe 58 on the boom 16 and/or eject the pipe 58 from the boom 16. For example, the conveyor can be a chain drive that is driven by an electrical and/or a hydraulic motor. It should be noted that the pipe engaging member 56 can be provided with a front surface constructed of a material to prevent sparking from occurring during loading and/or unloading the pipe 58. For example, the front surface can be constructed of a non-ferrous material, such as brass, bronze, aluminium or a plastic type material. Further, it should be understood that the foregoing are simply examples of ways that the pipe engaging member 56 and/or the conveyor may be made or used.

Figure 6:
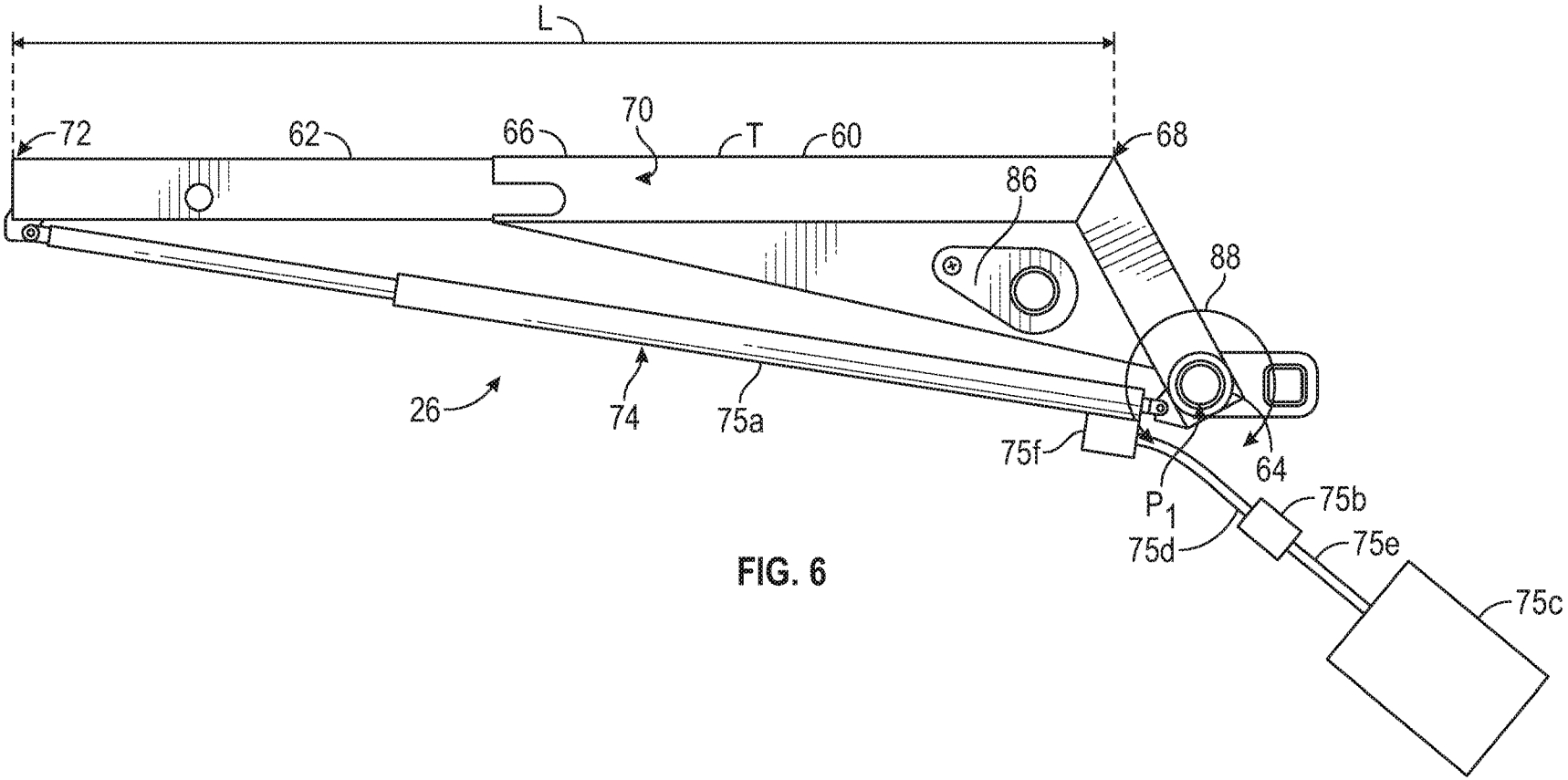
FIG. 6 is a side elevational view of an exemplary arm of the pipe handling apparatus illustrated in FIG. 1.

Referring to FIGS. 1 and 6, the boom 16 is positioned between the arms 26, and pivotally connected to the arms 26. FIG. 6 illustrates one embodiment of an exemplary arm 26. The arm 26 includes a first member 60 movably connected to a second member 62 such that a length L of the arm 26 may be adjusted. In some embodiments, the first member 60 and/or the second member 62 telescope relative to each other. For example, as illustrated in FIG. 6, the second member 62 may be configured to slide within the first member 60 in a telescopic fashion such that the arm 26 may be capable of being extended or retracted thus adjusting the length L of the arm 26. In some embodiments, the first members 60 and/or the second members 62 may be tubular in construction.

The first member 60 may include a first end 64 and a second end 66 with an angular section 68 between the first end 64 and the second end 66. An opening (not shown) may be formed in the first member 60 adjacent to the angular section 68 to permit the second member 62 to extend outwardly from the angular section 68 in some positions of the second member 62 relative to the first member 60. The second member 62 may include a first end 70 (shown in phantom) and a second end 72. The first end 70 of the second member 62 may have a smaller circumference relative to the second end 66 of the first member 60 such that the first end 70 of the second member 62 may be positioned within the first member 60 in a telescoping manner.

In some embodiments, a locking device 74 may aid in locking or unlocking a position of the first member 60 relative to the second member 62. For example, the locking device 74 may include a hydraulic cylinder 75*a*, a valve 75*b*, and a hydraulic accumulator 75*c*. The hydraulic cylinder 75*a* is pivotally connected at the second end 72 of the second member 62 and the opposing first end 64 of the first member 60. With the angular section 68 of the first member 60, a triangular formation may be formed with the locking device 74, the first member 60 and the second member 62 and with the locking device 74 being a hypotenuse. The hydraulic accumulator 75*c* is a pressure storage reservoir in which a non-compressible hydraulic fluid is held under pressure by an external source. The external source can be a spring, a raised weight, or a compressed gas. In one embodiment, the external source is a compressed gas having a pressure in a range from about 20 psi to about 120 psi, and preferably in a range from about 30 psi to about 40 psi.

The locking device 74 may act as a locking mechanism for the first member 60 and the second member 62. As a locking mechanism, use of the locking device 74 may allow for the second member 62 to be moveable relative to the first member 60 or the second member 62 to be fixed relative to the first member 60. When the locking device 74 is includes the hydraulic cylinder 75*a*, the hydraulic cylinder 75*a* may be connected to a series of conduits 75*d* and 75*e* for moving hydraulic fluid into or out of a cavity within the hydraulic cylinder 75*a* and from or to the hydraulic accumulator 75*c*. The locking device 74 may also be provided with a safety valve 75*f* connected to the hydraulic cylinder 75*a* and fluidly connected to the conduit 75*d* for preventing a release of pressure within the hydraulic cylinder 75*a* in the event that the conduit 75*d* or the conduit 75*e* erupts. The valve 75*b* may be positioned between and connected to the conduits 75*d* and 75*e* and be used to permit or restrict the ability of hydraulic fluid to flow into or out of the cavity from the hydraulic accumulator 75*c*. In a closed valve position, the hydraulic cylinder 75*a* locks the arm 26 at the set length L. In an open valve position, the hydraulic cylinder 75*a* allows the length L of the arm 26 to increase or decrease. For example, in the open valve position of the hydraulic cylinder 75*a*, fluid within the hydraulic cylinder 75*a* may be configured to flow such that the second member 62 is freely moveable relative to the first member 60 allowing for the length L of the arm 26 to increase or decrease. In a closed valve position of the hydraulic cylinder 75*a*, the second member 62 may be fixed relative to the first member 60 in a set position. In a fixed position, the second member 62 may not be extended or retracted relative to the first member 60. The locking device 74 can be implemented in other manners, such as by two interconnected threaded rods, or two non-threaded telescoping pipes having a clamp or chuck used to permit or restrict movement of the telescoping pipes relative to one another.

Referring to FIGS. 1 and 6, an actuator assembly 78 may be pivotally connected to the base 12 and the arm 26 for raising and lowering the arm 26 relative to the base 12. The actuator assembly 78 may be any mechanical or electromechanical system configured for raising and lowering the arm 26 and may include, but is not limited to, a hydraulic cylinder (as illustrated in FIG. 1), a threaded screw, an electromagnetic solenoid, and/or the like. In one example, the actuator assembly 78 may include a hydraulic cylinder with a first end 80 pivotally connected to a support frame 82 on the base 12. A second end 84 of the hydraulic cylinder may be pivotally connected to a support member 86 extending between and connected to the plurality of arms 26, such that the first end 64 may serve as the pivot point $P_1$ for the arms 26. To that end, the arms 26 may move about the pivot point $P_1$ as indicated by arrow 88 from a raised position to a lowered position (i.e., fully retracted within the base 12).

Figure 7:
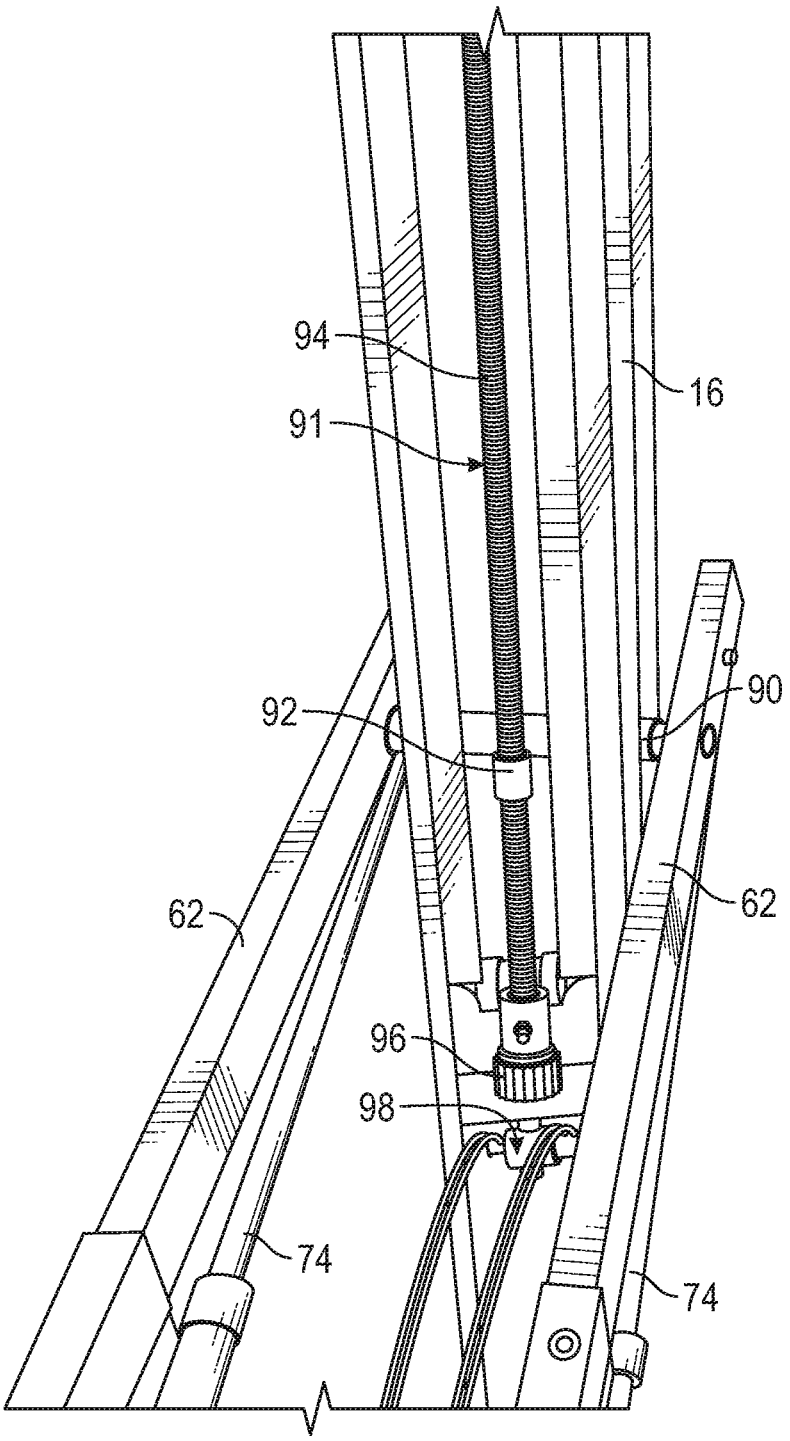
FIG. 7 is a magnified perspective view from underneath the boom showing a hinge point of the boom and arms illustrated in FIG. 1. A distal end of the boom is raised to a height H.

Referring to FIGS. 1 and 7, a pivot pin 90 extends through the elongated slot 54 of the boom and connects the second member 62 of each arm 26 with the boom 16. In some embodiments, the pivot pin 90 may include threaded ends configured to attach to the second member 62 of each arm 26.

The pivot pin 90 is rotatable and moveable within the elongated slot 54 of the boom 16 such that the pivot pin 90 serves as a hinge point between the boom 16 and the arms 26. In some embodiments, the pivot pin 90 may be positioned through the elongated slot 54 of the boom 16 joining the second members 62 of each arm 26. The pivot pin 90 may be cylindrical or any fanciful shape configured to allow for movement of the pivot pin 90 within the elongated slot 54. It should be noted that although the pivot pin 90 is illustrated as a single assembly, the pivot pin 90 may be any variety of pin (e.g., two-piece, three-piece) or other similar configuration configured to provide the pivot point P between the boom 16 and the arms 26.

Figure 8:
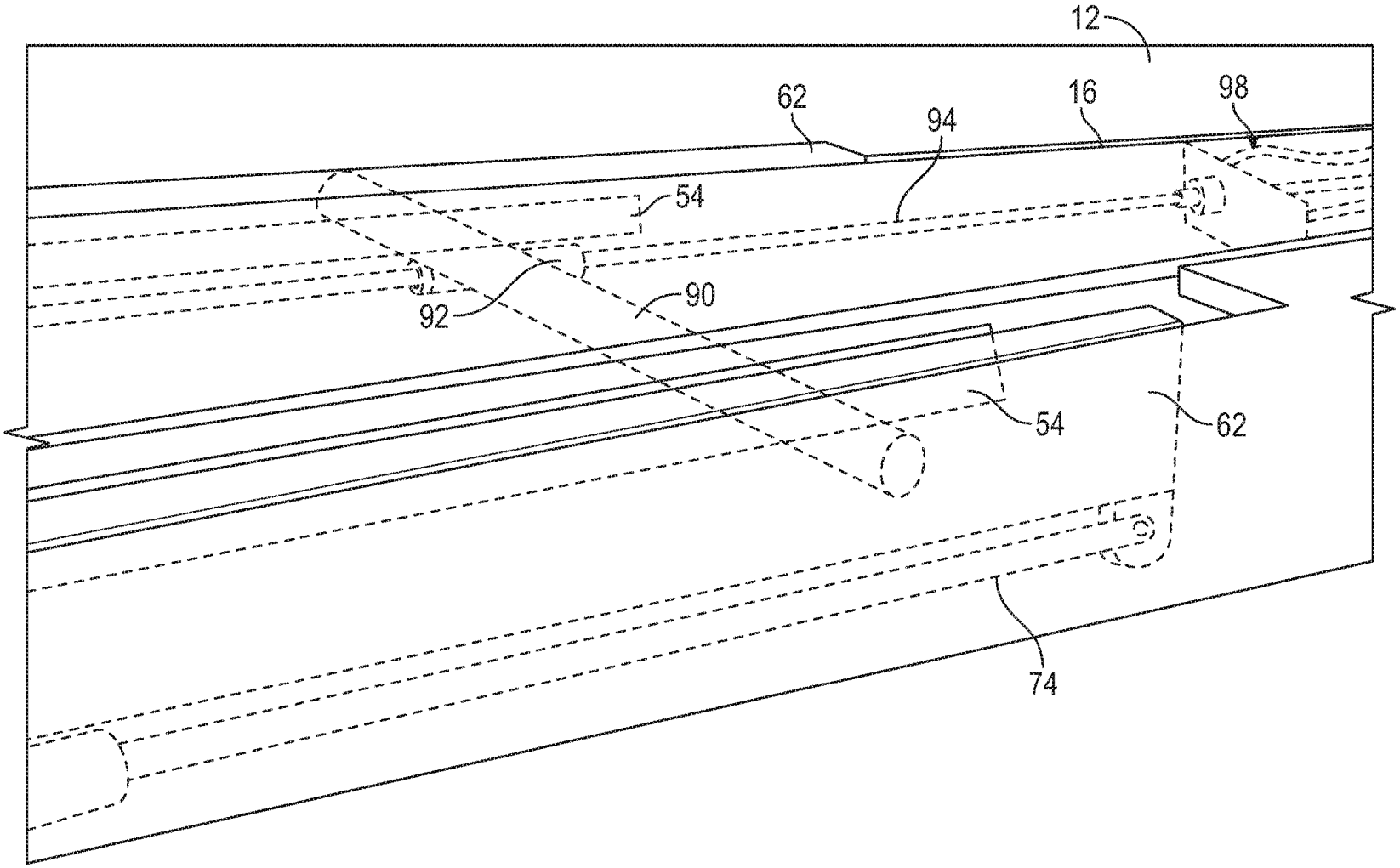
FIG. 8 is a magnified perspective view of the boom and arms illustrated in FIG. 1 nestably positioned within a base.

FIGS. 7 and 8 illustrate exemplary views of the arms 26 connected by the pivot pin 90 and straddling the boom 16. The pipe handling apparatus 10 may also be provided with a movement assembly 91 connected between the base 12 and the pivot pin 90 and for moving the pivot pin 90 within the elongated slot 54. The movement assembly 91 may be provided with a collar 92, a rod 94, a coupler 96 and a motor assembly 98. In this example, the pivot pin 90 may be connected to the collar 92. The collar 92 may be movable about the rod 94 traversing at least a portion of the boom 16 and fixedly connected to the pivot pin 90. For example, the collar 92 can be welded to the pivot pin 90. In some embodiments, the collar 92 may be threaded. The rod 94 may be attached to the coupler 96 with the coupler 96 connected to the motor assembly 98 (e.g., hydraulic motor, electric motor) such that the motor assembly 98 is configured to turn the coupler 96 and thus the rod 94. Turning of the coupler 96 may reposition the collar 92, and thus the pivot pin 90, along a length of the rod 94 such that the pivot pin 90 may be positioned at varying positions within the elongated slot 54.

Referring to FIGS. 2B and 3B, repositioning of the pivot pin 90 on the rod 94 may vary the distance D the boom 16 may extend from the base 12. For example, in FIG. 2B, the pivot pin 90 is positioned at a distal end 100 of the elongated slot 54. With the arm 26 in the raised position, the boom 16 extends from the base 12 at the distance D. In comparison, the distance D is greater, as illustrated in FIG. 3B, with the pivot pin 90 positioned at a proximal end 102 of the elongated slot 54. Generally, repositioning of the pivot pin 90 on the rod 94 may be as the boom 16 rests in the nesting position within the base 12. FIG. 8 illustrates an exemplary view of the pivot pin 90 in the nesting position within the base 12.

FIGS. 2A, 2B, 3A and 3B illustrate automated adjustment of the boom 16 facilitated by movement of the pivot pin 90 within the elongated slot 54, as well as, lengthening and retraction of the arms 26 to provide variable heights H for the pipe handling apparatus 10. The automated adjustment of the boom 16 may be such that the distal end 20 of the boom 16 is positioned into one or more raised positions (exemplary raised positions are illustrated in FIGS. 2B and 3B), or resting position shown in FIGS. 2A and 3A. Adjustment of the boom 16 between any raised position height, and/or from a raised position height to the resting position may be automated (i.e., without human intervention). To that end, variable height positioning of the distal end 20 of the boom 16 may be achieved without manual intervention. Even further, during use, adjustments to height H may be made without pre-defined spacings or pre-determined heights.

Referring to FIGS. 2A and 2B, in operation, the pipe handling apparatus 10 may be positioned in the fully retracted position (i.e., the nesting position). The pivot pin 90 may be adjusted while the pipe handling apparatus 10 is in the nesting position. The pivot pin 90 may be adjusted to any position within the elongated slot 54 by unlocking the locking devices 74; actuating the motor assembly 98 to simultaneously move the pivot pin 90 within the elongated slot 54 thereby extending or retracting the arms 26; deactuating the motor assembly 98; and locking the locking devices 74. For example, in FIGS. 2A and 2B, the pivot pin 90 is position at the distal end 100 of the elongated slot 54. Once the pivot pin 90 is positioned, the actuator assembly 78 may raise and/or lower the arms 26 any number of times by moving the support member 86 about a pivot point $P_1$.

Thereafter, the length L of the arms 26 may be adjusted again by unlocking the locking devices 74 when the pipe handling apparatus 10 is in the nesting position, and then actuating the motor assembly 98 to telescopically adjust the second member 62 relative to the first member 60. Adjustment of the length L of the arms 26 may increase or decrease the height H of the distal end 20 of the boom 16. Once a desired position of the pivot pin 90 within the elongated slot 54 is reached (thereby resulting in a height H of the distal end 20 of the boom 16 in the extended position), the locking devices 74 may be locked (e.g., by closing the valve) to lock the second member 62 of the arms 26 relative to the first member 60 of the arms 26 fixing the length L of the arms 26. The proximal end 18 of the boom 16 may remain within the channel 14 moving from the proximal end 36 of the channel 14 towards the distal end 38 of the channel 14 as the distal end 20 of the boom 16 is raised. As the distal end 20 of the boom 16 is lowered, the proximal end 18 of the boom 16 moves from the distal end 38 of the channel 14 toward the proximal end 36 of the channel. This movement of the distal end 20 of the boom 16 may be guided by the track 22.

The one or more pipes 58 received on the boom 16 may thus be raised and/or lowered from one or more heights H. For example, a single pipe may be received on the boom 16 in a horizontal position from a pipe rack. Once the pipe 58 is received on the boom 16, the distal end 20 of the boom 16 may be raised to a first height $H_1$ (e.g., positioning the distal end 20 of the boom 16 adjacent to an elevated drill floor). The actuator assembly 78 may apply force to cause arms 26 to rotate to the raised position about the pivot point $P_1$.

With the boom 16 in the raised position, and the arms 26 in a locked position, the pipe 58 may be unloaded from the boom 16 (e.g., onto the elevated drill floor). Even further, adjustments from the height H to a different height may be made (in the nesting position) without pre-determined calculations or determinations and without manual adjustment of the length L of the arms 26.

Once the pipe 58 is unloaded from the boom 16, the distal end 20 of the boom 16 and the plurality of arms 26 may be retracted to be nestably positioned within the channel 14 as illustrated in FIGS. 2A, 3A, and 8. For example, the actuator assembly 78 may rotate the support member 86 lowering the arms 26 causing the distal end 20 of the boom 16 to be lowered. The boom 16 and the arms 26 may be lowered and nestably positioned within the channel 14.

From the above description, it is clear that the inventive concepts disclosed and claimed herein are well adapted to carry out the objects and to attain the advantages mentioned herein, as well as those inherent in the invention. While exemplary embodiments of the inventive concepts have been described for purposes of this disclosure, it will be understood that numerous changes may be made which will readily suggest themselves to those skilled in the art and which are accomplished within the spirit of the inventive concepts disclosed and claimed herein.

What is claimed is:

1. A pipe handling apparatus for unloading and loading a pipe, comprising:

a base having a proximal end and a distal end and a channel extending between the proximal end and the distal end of said base, said channel defining an elongated track;

a boom having a proximal end and a distal end with a trough extending between the proximal end and the distal end of the boom and being configured to receive at least one pipe therein, the proximal end of said boom being positioned within said track and arranged for guided movement from a retracted position wherein said boom is nested within said channel to a raised position wherein the distal end of said boom is in an elevated position relative to said base, the boom having a mechanical structure defining an elongated slot extending between the proximal end and the distal end;

a pivot pin extending through the elongated slot and arranged for selective movement along the elongated slot;

an arm comprising:

a first member pivotally connected to the base at a pivot location; and, a second member, having a first portion connected to the pivot pin, and a second portion movably connected to the first member; and a locking device comprising a hydraulic cylinder having one end pivotally connected to the second member and the other end attached to the first member, said hydraulic cylinder being interconnected with a valve and a hydraulic accumulator, the valve having a closed position in which pressure within the hydraulic accumulator and hydraulic cylinder locks the second member from moving relative to the first member, and an open position in which fluid can flow between the hydraulic cylinder and the hydraulic accumulator permitting adjustment of the second member relative to the first member, wherein when said boom is nested within said channel, and the valve is open, the pivot pin is moveable within the elongated slot to any desired position with the result that the position of the second member is adjusted relative to the position of the first member; and wherein the valve is maintained in the closed position when the boom is moved to the raised position.

2. The pipe handling apparatus of claim 1, wherein the boom further comprises a rod extending between the proximal end and the distal end of the boom, the pivot pin being movably coupled to the rod.

3. The pipe handling apparatus of claim 2, wherein the rod is threaded, the pivot pin being threadably coupled to the rod such that rotation of the rod causes the pivot pin to move along the rod.

4. The pipe handling apparatus of claim 3, wherein the rod is connected to a motor assembly configured to rotate the rod.

5. The pipe handling apparatus of claim 1, wherein the mechanical structure includes a beam having a first side and a second side, and wherein the elongated slot is formed within the first side and the second side of the beam.

6. The pipe handling apparatus of claim 1, wherein the boom includes a beam having a first side and a second side, and the mechanical structure is positioned below the beam and supported by the beam.

7. The pipe handling apparatus of claim 1, further comprising:

an actuator assembly having a first actuator portion connected to a support member attached to the base and a second actuator portion attached to at least one first member of the arm, the actuator assembly configured to extend or retract with the result that the first member of the arm rotates about its pivot location to thereby raise or lower the arm.

8. The pipe handing apparatus of claim 1, wherein the boom further includes the trough extending from the proximal end to the distal end of the boom and configured to accept the pipe therein.

9. The pipe handling apparatus of claim 1, wherein the pivot pin is moveable within the elongated slot of the boom such that the pivot pin serves as a hinge point between the boom and the arm.

10. A pipe handling apparatus, comprising:

a base having a proximal end and a distal end and a channel extending between the proximal end and the distal end of the base;

a boom having a proximal end and a distal end with a trough extending between the proximal end and the distal end configured to receive at least one pipe therein, the proximal end of the boom positioned within and guided by an elongated track defined within the channel of the base, the boom having an elongated slot;

a plurality of arms arranged in opposed spaced relationship on either side of the boom, each arm having a first member pivotally connected to the base and a second member having an inwardly extending end configured to move telescopically within the first member, the second member having an outwardly extending end connected to a pivot pin positioned within and extending through the elongated slot, the pivot pin being arranged to connect the outwardly extending ends of each second member of the plurality of arms, and a support member connecting each of said first members of said plurality of arms;

at least one locking device comprising a hydraulic cylinder having one end pivotally connected to a second member and the other end attached to a first member, said hydraulic cylinder being interconnected with a valve and a hydraulic accumulator whereby pressure within the hydraulic accumulator locks said second member from moving relative to the first member when the valve is closed;

wherein when said boom is nested within said channel, and the valve is open, the pivot pin is moveable within the elongated slot thereby resulting in an adjustment of the second member relative to the first member to any desired position within the elongated slot; and, an actuator assembly connected to the support member and the base, the actuator assembly configured to extend or retract when the valve is maintained in the closed position with the result that said first members of the pair of arms rotate about their respective pivot point locations on the base to thereby raise or lower the arms relative to the base.

11. The pipe handling apparatus of claim 10, wherein an open position of said valve releases pressure from said hydraulic accumulator which allows the first member of at least one arm to move relative to the second member of the arm.

12. The pipe handling apparatus of claim 10, wherein a closed position of said valve locks the first member of the arm relative to the second member of the arm in a fixed position.

* * * * *